US008640508B2

(12) United States Patent
Maddox et al.

(10) Patent No.: US 8,640,508 B2
(45) Date of Patent: Feb. 4, 2014

(54) APPARATUS FOR RELEASING MAGNETIC SECURITY DEVICE

(75) Inventors: Sean Geoffrey Maddox, Stamford (GB); Peter Antony Farrar, Menston (GB); Robert Johnston, Geddington (GB)

(73) Assignee: Dubois Limited, Northants (GB)

( * ) Notice: Subject to any disclaimer, the term of this patent is extended or adjusted under 35 U.S.C. 154(b) by 1170 days.

(21) Appl. No.: 10/540,326

(22) PCT Filed: Oct. 14, 2004

(86) PCT No.: PCT/GB2004/004364

§ 371 (c)(1),
(2), (4) Date: Jan. 25, 2006

(87) PCT Pub. No.: WO2004/040531

PCT Pub. Date: May 6, 2005

(65) Prior Publication Data

US 2006/0137408 A1 Jun. 29, 2006

(30) Foreign Application Priority Data

Oct. 17, 2003 (GB) ..... 0324341.7

(51) Int. Cl.
*E05B 65/00* (2006.01)

(52) U.S. Cl.
USPC ... 70/57.1; 70/58; 70/63; 206/1.5; 206/308.1; 206/308.2; 206/387.11

(58) Field of Classification Search
USPC ..... 70/57, 57.1, 58, 63, 276, 413; 206/1.5, 206/307, 308.1, 308.2, 387.1, 387.11
See application file for complete search history.

(56) References Cited

U.S. PATENT DOCUMENTS 4,527,310 A * 7/1985 Vandebult ..... 70/57.1
5,535,606 A * 7/1996 Nguyen et al. ..... 70/57.1

(Continued)

FOREIGN PATENT DOCUMENTS

EP 1298268 4/2003
GB 2371597 7/2002

(Continued)

OTHER PUBLICATIONS

WO2005040531A1, "International Search Report," May 6, 2005.

*Primary Examiner* — Christopher Boswell
(74) *Attorney, Agent, or Firm* — Pillsbury Winthrop Shaw Pittman LLP

(57) ABSTRACT

Apparatus for releasing a magnetic security device used to inhibit unauthorised access to and/or unauthorised removal of an article. The apparatus has a first portion (1) for locating an article in a first direction (D1) and a second portion (2) for locating an article in a second direction (D2) perpendicular to the first direction (D1), so providing an L-shaped slot or receptacle capable of receiving articles of a wide range of shapes and sizes having a security device installed adjacent two substantially perpendicular sides thereof. The first and/or second portions include magnetic release means for releasing a lock securing the security device to the article and arranged to assist in locating the article in a third direction (M) perpendicular to the first and second directions (D1, D2) by magnetic attraction of the security device as the article is brought into contact with the first and second portions to align the magnetic security device with the magnetic release means.

18 Claims, 7 Drawing Sheets

(56) References Cited

U.S. PATENT DOCUMENTS

| | | | | |
|---|---|---|---|---|
| 5,598,728 | A * | 2/1997 | Lax | 70/57.1 |
| 5,768,922 | A * | 6/1998 | Lax | 70/57.1 |
| 5,850,752 | A * | 12/1998 | Lax | 70/57.1 |
| 5,904,246 | A * | 5/1999 | Weisburn et al. | 206/308.2 |
| 5,956,981 | A * | 9/1999 | Weisburn et al. | 70/57.1 |
| 5,988,376 | A * | 11/1999 | Lax | 70/63 |
| 6,082,156 | A * | 7/2000 | Bin | 70/57.1 |
| 6,084,498 | A * | 7/2000 | Stelter et al. | 335/306 |
| 6,467,318 | B1 * | 10/2002 | Gattiker | 70/57.1 |
| D468,621 | S * | 1/2003 | Farrar et al. | D8/339 |
| 6,598,742 | B1 * | 7/2003 | Belden et al. | 70/57.1 |
| 6,601,415 | B2 * | 8/2003 | Takinami | 70/57.1 |
| 6,601,702 | B2 * | 8/2003 | Byrne et al. | 70/63 |
| 6,637,589 | B2 * | 10/2003 | Broadhead | 70/57.1 |
| 6,832,498 | B2 * | 12/2004 | Belden et al. | 70/57.1 |
| 6,880,372 | B2 * | 4/2005 | Kim | 70/57.1 |
| 6,931,895 | B1 * | 8/2005 | Ahn | 70/57.1 |
| 7,140,489 | B2 * | 11/2006 | Lax et al. | 70/57.1 |
| 7,315,253 | B1 * | 1/2008 | Pijanowski et al. | 340/686.1 |
| 7,404,484 | B2 * | 7/2008 | Farrar et al. | 70/57.1 |
| 7,526,931 | B2 | 5/2009 | Burdett et al. | |
| 2002/0000111 | A1 | 1/2002 | Belden et al. | |
| 2003/0094021 | A1 | 5/2003 | Takinami | |
| 2004/0123311 | A1 * | 6/2004 | Farrar et al. | 206/308.2 |
| 2004/0129587 | A1 | 7/2004 | Lax et al. | |
| 2004/0177657 | A1 * | 9/2004 | Kim | 70/57.1 |
| 2004/0182119 | A1 * | 9/2004 | Lax et al. | 70/57.1 |
| 2005/0160774 | A1 * | 7/2005 | Weinstein et al. | 70/57.1 |
| 2006/0124481 | A1 | 6/2006 | Burdett et al. | |
| 2006/0137410 | A1 * | 6/2006 | Choi et al. | 70/57.1 |
| 2006/0254326 | A1 * | 11/2006 | Lax et al. | 70/57.1 |

FOREIGN PATENT DOCUMENTS

| | | |
|---|---|---|
| WO | WO01/20107 | 3/2001 |
| WO | WO01/31152 | 5/2001 |
| WO | WO0183325 | 11/2001 |

* cited by examiner

APPARATUS FOR RELEASING MAGNETIC SECURITY DEVICE

TECHNICAL FIELD

This invention relates to apparatus for releasing a magnetic security device used to inhibit unauthorised access to or unauthorised removal of an article for sale. Although applicable to a wide range of articles, it is particularly suited for releasing a security device within a container housing some form of information storage media, for example a CD or DVD. The invention also relates to a method of releasing a magnetic security device using such apparatus.

BACKGROUND ART

The invention is an extension of apparatus described in GB2371597A, the disclosure of which is incorporated herein. This apparatus is also disclosed in WO 02/39451.

GB2371597A describes the principles of operation of a magnetic security device of the type described therein and of the apparatus used to release the security device. The embodiments described in GB2371597A relate to apparatus specifically designed to release such a security device from a CD or DVD box.

A 'magnetic' security device is to be understood as including devices which comprise one or more magnets and/or comprise components capable of being attracted by a magnet, e.g. a metal arm formed of steel or a non-magnetic arm with a magnet or steel component secured thereto.

The present invention seeks to provide apparatus which provides further advantages over this prior art.

SUMMARY OF INVENTION

According to a first aspect of the invention there is provided apparatus for releasing a magnetic security device used to inhibit unauthorised access to and/or unauthorised removal of an article, the apparatus comprising: a first portion for locating an article in a first direction (D1) and a second portion for locating an article in a second direction (D2) substantially perpendicular to the first direction (D1), so the article is physically restrained in only the first and second directions (D1, D2) as it is brought into in contact with the first and second portions; the first and/or second portions including magnetic release means arranged to assist in locating the article in a third direction (D3) substantially perpendicular to the first and second directions (D1, D2) by magnetic attraction of the security device as the article is brought into contact with the first and second portions so as to align the magnetic security device with the magnetic release means.

According to a second aspect of the invention there is provided apparatus for releasing a magnetic security device used to inhibit unauthorised access to and/or unauthorised removal of an article, the apparatus comprising: a first portion for locating an article in a first direction (D1) and a second portion for locating an article in a second direction (D2) substantially perpendicular to the first direction (D1), so as to provide an L-shaped slot or receptacle capable of receiving articles of a wide range of shapes and sizes having a security device installed adjacent two substantially perpendicular sides thereof, the first and/or second portions including magnetic release means.

Preferably, the magnetic release means is arranged to assist in locating the article in a third direction (D3) substantially perpendicular to the first and second directions (D1, D2) by magnetic attraction of the security device as the article is brought into contact with the first and second portions so as to align the magnetic security device with the magnetic release means.

According to another aspect of the invention there is provided a method of releasing a magnetic security device used to inhibit unauthorised access to and/or unauthorised removal of an article comprising the steps of providing apparatus as defined above and presenting an article with a magnetic security device thereto to release the magnetic security device therefrom.

BRIEF DESCRIPTION OF DRAWINGS

The invention will now be further described, merely by way of example, with reference to the accompanying drawings, in which.

DESCRIPTION OF PREFERRED EMBODIMENTS

Figure 1B:
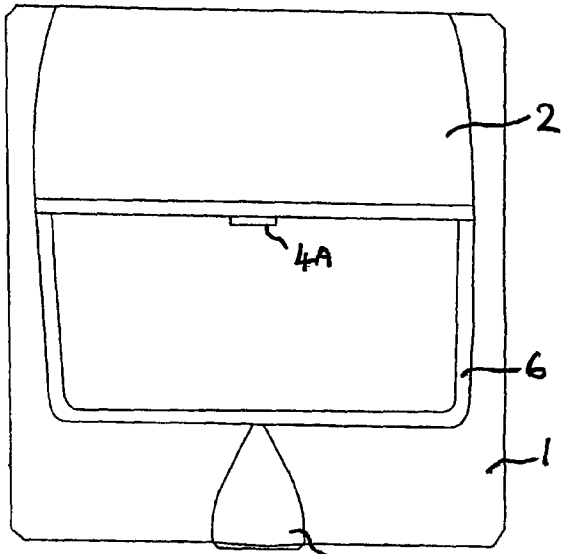
FIGS. 1A, 1B, 1C and 1D show a perspective view, plan view, side view and front view, respectively, of a first embodiment of apparatus according to the invention (with a cover shown in an open position)
Figure 1D:
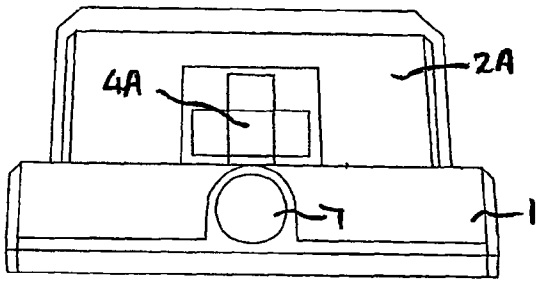

The apparatus shown in FIGS. 1-4 comprises a base portion 1 and a top portion 2. FIGS. 1-2 show the apparatus when these two portions are assembled together and FIGS. 3 and 4 respectively show the first and second portions separately. The base portion 1 incorporates a first part 3 of magnetic release means (shown in dotted lines in FIG. 1C) and the top portion 2 incorporates a second part 4 of the magnetic release means. In the embodiment shown, the first part of the magnetic release means comprises a first magnet 3 which is concealed beneath an upper surface 1A of the base portion 1 (and so is not visible in FIG. 1A). The second part of the magnetic release means comprises a second magnet 4 mounted adjacent a front face 2A of the top portion 2. The first and second magnets are arranged to apply magnetic forces to a security device in two substantially perpendicular directions.

The first and second magnets 3 and 4 will be described further below with reference to FIG. 7.

The base portion 1 presents a flat upper surface 1A upon which an article with a security device is placed so as to locate the article in a vertical direction D1. The top portion 2 presents a front face 2A incorporating the second magnet 4. In the embodiment shown, part of the second magnet 4 projects slightly (e.g. by 1 or 2 mm) from the front surface 4A and the article is moved into contact with this so as to locate the article in a horizontal, forward/backward direction D2.

The magnets 3 and/or 4 are arranged to assist in locating the article in the horizontal, lateral direction D3 as the article is moved into contact with the base portion 1 and top portion 2 so as to align the magnetic security device thereof with the first and/second magnets 3 and 4.

The article is thus physically restrained in only the first and second directions D1, D2 as it is brought into contact with the first and second portions 1, 2. It has been found that the magnetic attraction between the magnets 3 and/or 4 and the magnetic security device is sufficient to ensure the article is located in the lateral direction D3 with the magnetic security device in alignment with the first and/or second magnets 3, 4 if the article is presented in approximate alignment therewith. There is therefore no need to provide any lateral guides or restraints to assist in locating the article laterally. There is also no need to proved an upper guide for guiding or restraining an upper surface of the article as it can be located vertically simply by being moved into contact with the base portion 1.

Such an arrangement thus removes any limitation on the height or width of an article that can be presented to the apparatus to release a magnetic security device therefrom. This enables the same apparatus to be used to release security devices installed in a wide variety of products (which may be of many different shapes or sizes). The retail outlet can thus use the same apparatus to release security devices from articles such as CD or DVD boxes and from other articles such as boxes, enclosures, capsules or packaging used to house or display other goods, e.g. high value items and/or potentially dangerous items, to which it is desirable to inhibit unauthorised access. Such goods may, for example, include memory cards (recorded or unrecorded), jewellery, medicaments and pharmaceuticals. A wide variety of other goods can be packaged in a manner which requires release of a security device of the type referred to above to permit access to an/or removal of the goods and which can be released using this apparatus.

The apparatus thus presents an L-shaped slot or receptacle capable of receiving articles of a wide variety of shapes and sizes. This L-shaped slot or receptacle is formed by two substantially perpendicular surfaces without other components restricting the shape or size of the article which can be presented thereto so long as the article has two substantially perpendicular sides for locating against these two surfaces. Articles can also be presented to the apparatus from a variety of angles or directions so long as they are brought into engagement with the said two surfaces. There is therefore no need for the article to be presented along a specific, constrained pathway.

The base portion 1 is preferably designed so that it can be securely fastened to a surface, e.g. of a counter adjacent a sales till. The base portion 1 may be bolted to the surface and FIG. 1A shows covers 1B and 1C covering through-holes housing two such bolts.

The apparatus is also preferably arranged so that it can be locked in an inoperative mode to prevent unauthorised use, e.g. when a retail outlet is closed. The embodiment shown in FIGS. 1 and 2 is provided with a slidable or pivotable cover 5 (shown in the open position in FIG. 1 and in the closed position in FIG. 2). When closed, edges of the cover 5 fit within a groove 6 around the periphery of the surface 1A and the cover 5 can be secured in this position by means of a lock 7.

Figure 1A:
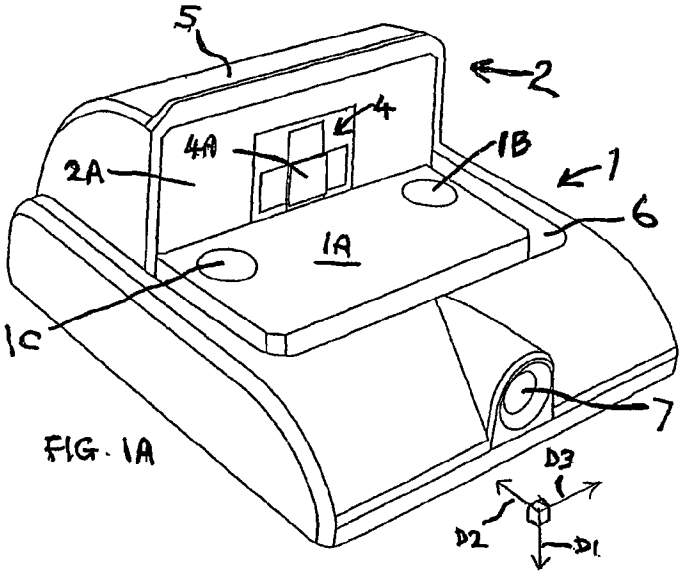
Figure 1C:
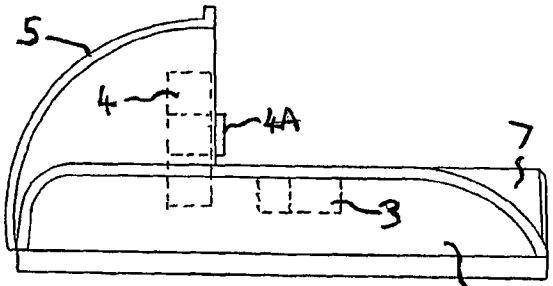
Figure 2A:
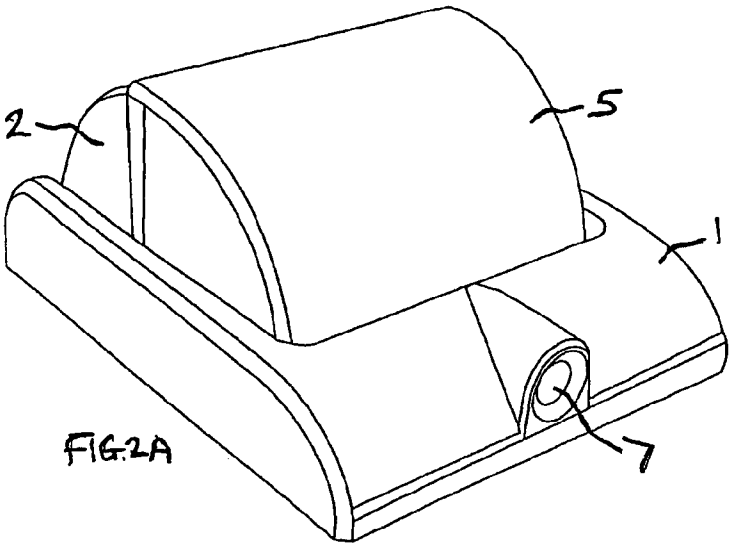
FIGS. 2A, 2B, 2C and 2D correspond to FIGS. 1A, 1B, 1C and 1D, respectively; but with the cover shown in a closed position.
Figure 2B:
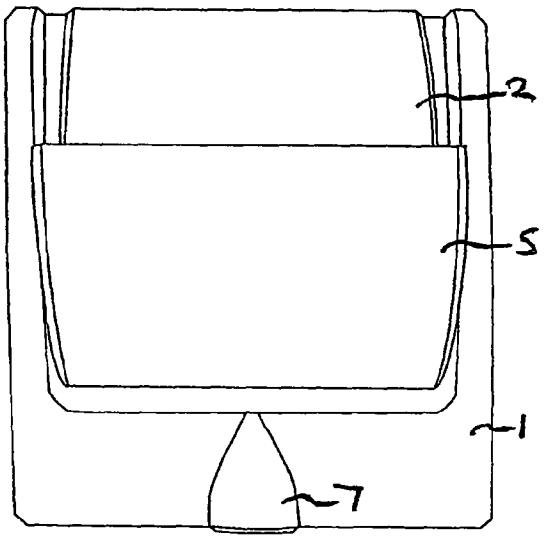
Figure 2C:
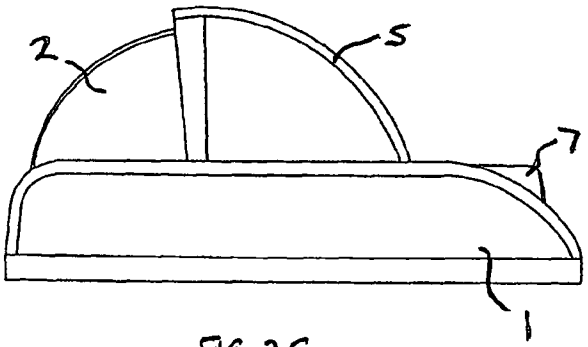
Figure 2D:
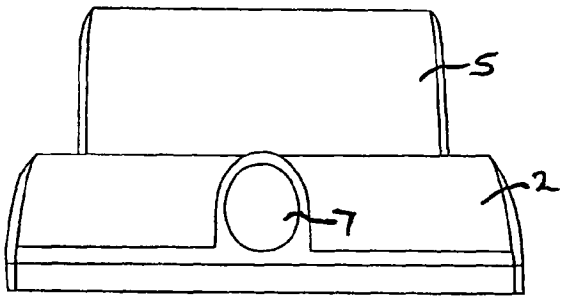
Figure 3B:
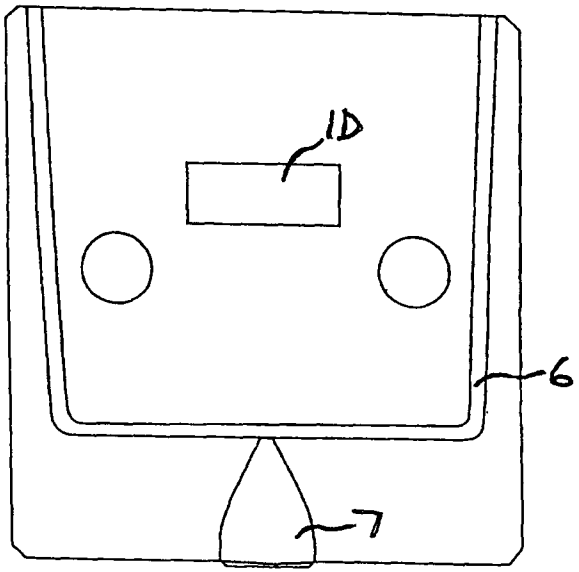
FIGS. 3A, 3B, 3C and 3D show a perspective view, plan view, side view and front view of a first component of the apparatus shown in FIG. 1.
Figure 3D:
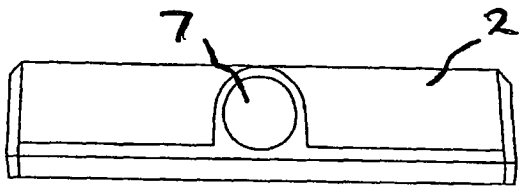
Figure 3A:
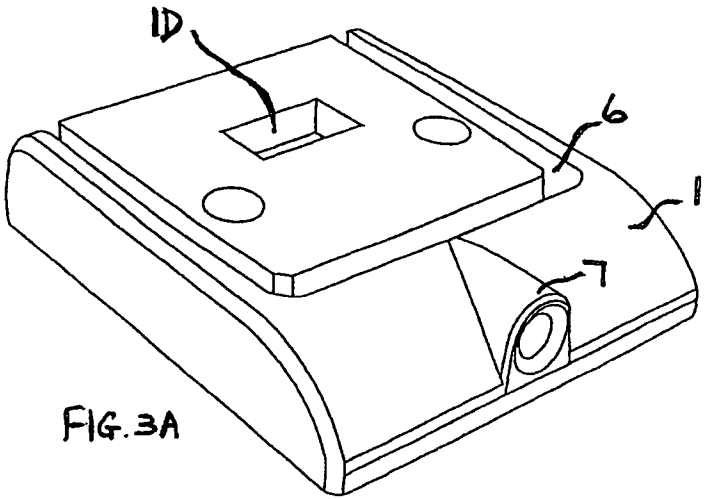
Figure 3C:
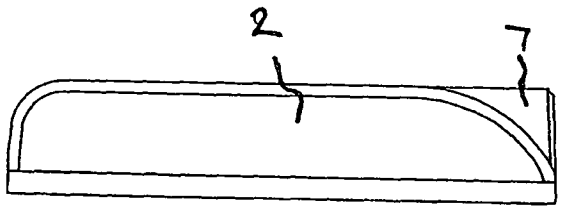
Figure 4A:
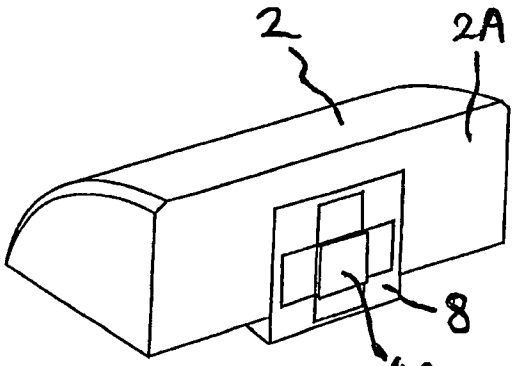
FIGS. 4A, 4B, 4C and 4D show a perspective view, plan view, side view and front view of a second component of the apparatus shown in FIG. 1.
Figure 4B:
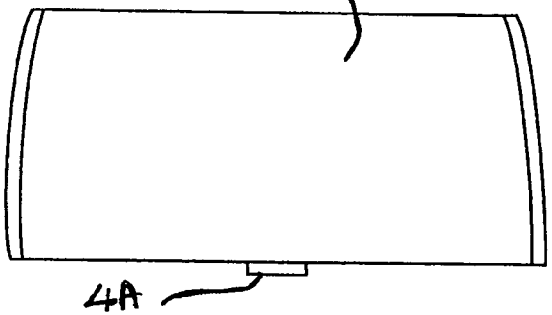
Figure 4C:
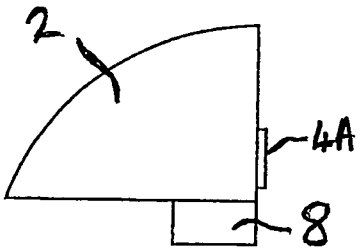
Figure 4D:
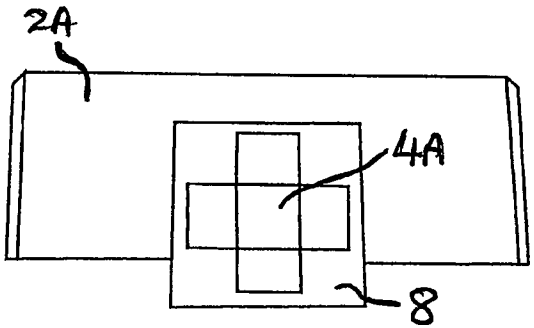

As shown in FIGS. 1B and 1C, a portion 4A of the second magnet 4 preferably projects a small distance out of the plane of the front face 2A of the top portion 2. As explained in GB2371597A, during the release operation, the security device is preferably pressed further into the article to assist in the release of a locking mechanism locking it to the article. The portion 4A of the second magnet should thus be of similar size, or smaller, than a head of the security device so, when an article is positioned so that the portion 4A engages the head of the security device, the article can be pushed towards the face 2A so the portion 4A pushes the security device further into the article.

FIGS. 2A, 2B, 2C and 2D show views corresponding to those of FIGS. 1A, 1B, 1C and 1D and show the same apparatus but with the cover 5 in the closed position.

The apparatus is preferably designed so the base and top portion 1 and 2 can be made separately and then assembled together. FIGS. 3A, 3B, 3C and 3D respectively show a perspective view, plan view, side view and front view of the base portion 1. As shown, the base portion 1 includes a recess 1D into which part of the top portion 2 fits.

FIGS. 4A, 4B, 4C and 4D respectively show a perspective view, plan view, side view and front view of the top portion with the second magnet 4 installed therein (but excluding the cover 5). The second magnet 4 is mounted in a support 8 which projects from the underside of the top portion 2 and fits within the recess 1D when the top portion 2 is assembled with the base portion 1.

Figure 5B:
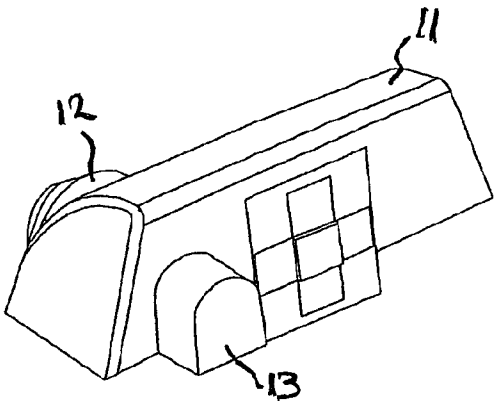
FIGS. 5A, 5B and 5C show perspective views of a second embodiment of apparatus according to the invention and a first component and second component thereof, respectively.
Figure 5C:
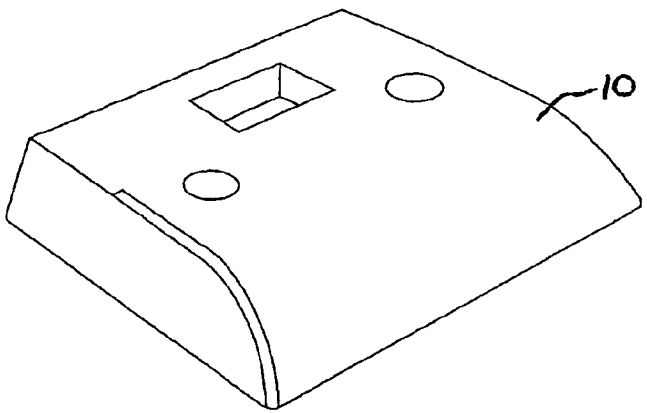
Figure 5A:
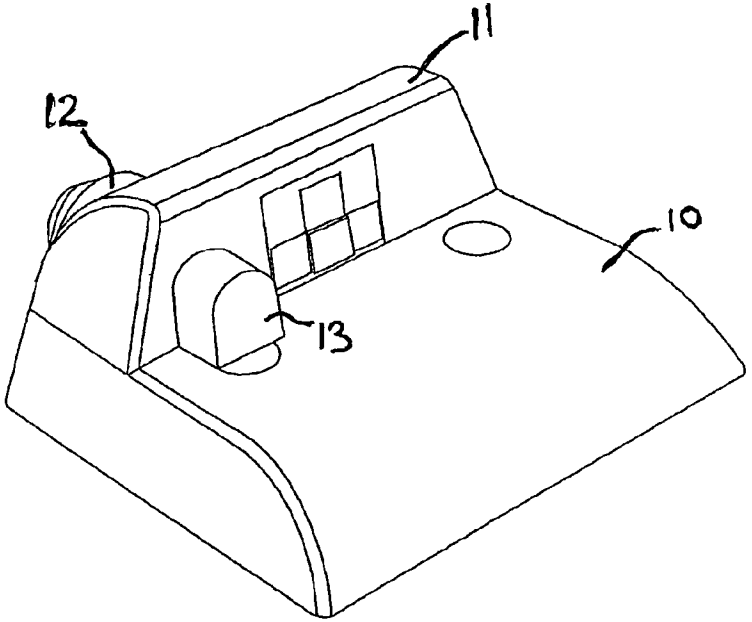

FIG. 5A is a perspective view of a second embodiment of apparatus according to the present invention again comprising a base portion 10 and a top portion 11 with magnetic release means therein. Although of slightly different shape, this is similar to the first embodiment except that it is not provided with a lockable cover 5 but instead has a lock 12 positioned in the top portion 11. In the locked configuration shown, an obstructing member 13 is locked in a projecting position which prevents an article being brought into a position in which the magnetic release means is able to release a security device therein.

FIGS. 5B and 5C are perspective views of the top portion 11 and base portion 10 prior to assembly.

Figure 6:
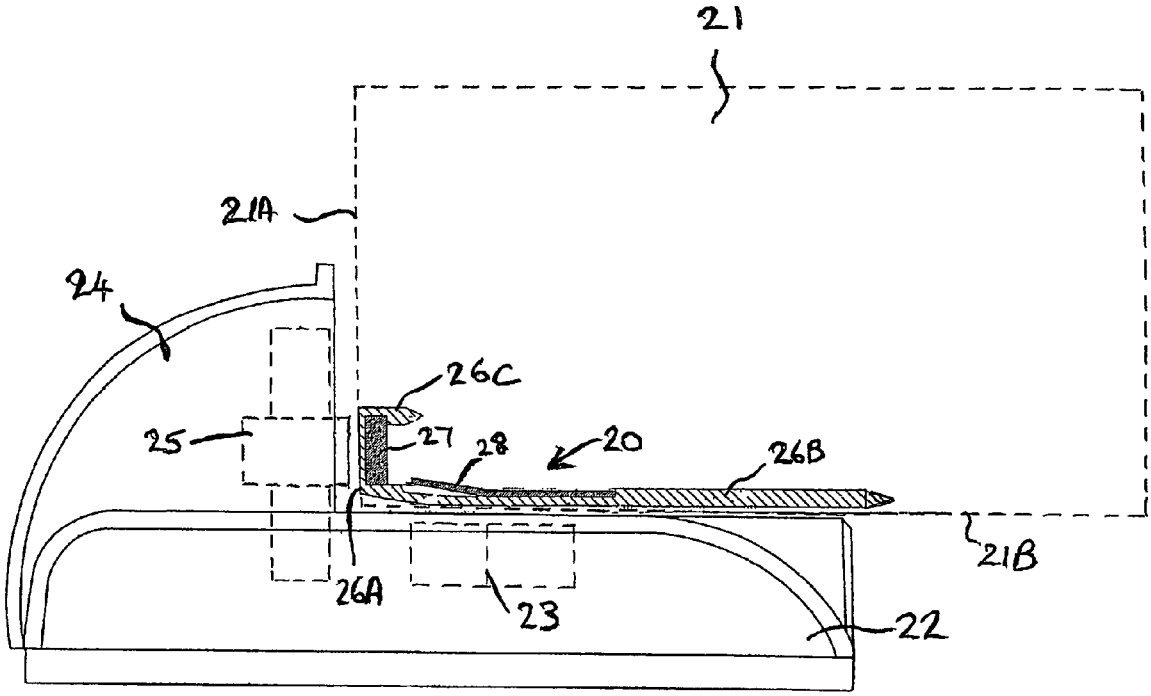
FIG. 6 is a side view of apparatus such as that shown in FIG. 1 illustrating its use release a security device from an article.

FIG. 6 illustrates the use of apparatus of the type described above to release a magnetic security device 20 from an article 21 (shown in dotted lines).

As described above, the apparatus comprises a base portion 22 with a first magnet 23 therein (shown in dotted lines) and a top portion 24 with a second magnet 25 therein (also shown in dotted lines). The magnetic security device 20 comprises a plastics component 26 with a head portion 26A, a long arm 26B and a short arm 26C. A metal insert 27 is provided in the head portion 26A and a metal locking member 28 is movably mounted on the long arm 26B. The security device is installed in the article 21 so that the head portion 26A lies adjacent a first side 21A of the article and the long arm 25B lies adjacent a second side 21B of the article (the first and second sides 21A and 21B being adjacent each other and substantially perpendicular to each other).

The article 21 is presented to the apparatus in the appropriate orientation so that the head portion 26A of the security device therein is positioned approximately in alignment with the second magnet 25. The magnetic attraction between the second magnet 25 and the metal insert 27 in the head portion 26A of the security device assists in bringing the head portion 26A into alignment with the second magnet 25.

When the article 21 is pressed towards the top portion 24, a projecting portion of the second-magnet 25 serves to push the security device 20 further into the article 21 to disengage locking arm 28 from a detent (not shown) therein. The first magnet 23 is then able to move the locking member 28 downwards to prevent it re-engaging with the detent. If the article 21 is then pulled away from the apparatus, the security device 20 is held stationary by the magnets 23 and/or 25 so is at least partially withdrawn from the article 21 as the article is moved away from the apparatus.

Thus, the second magnet 25 acts to attract the security device in the direction D2 whilst the first magnet 23 acts to attract the locking arm in the direction D1.

Figure 7:
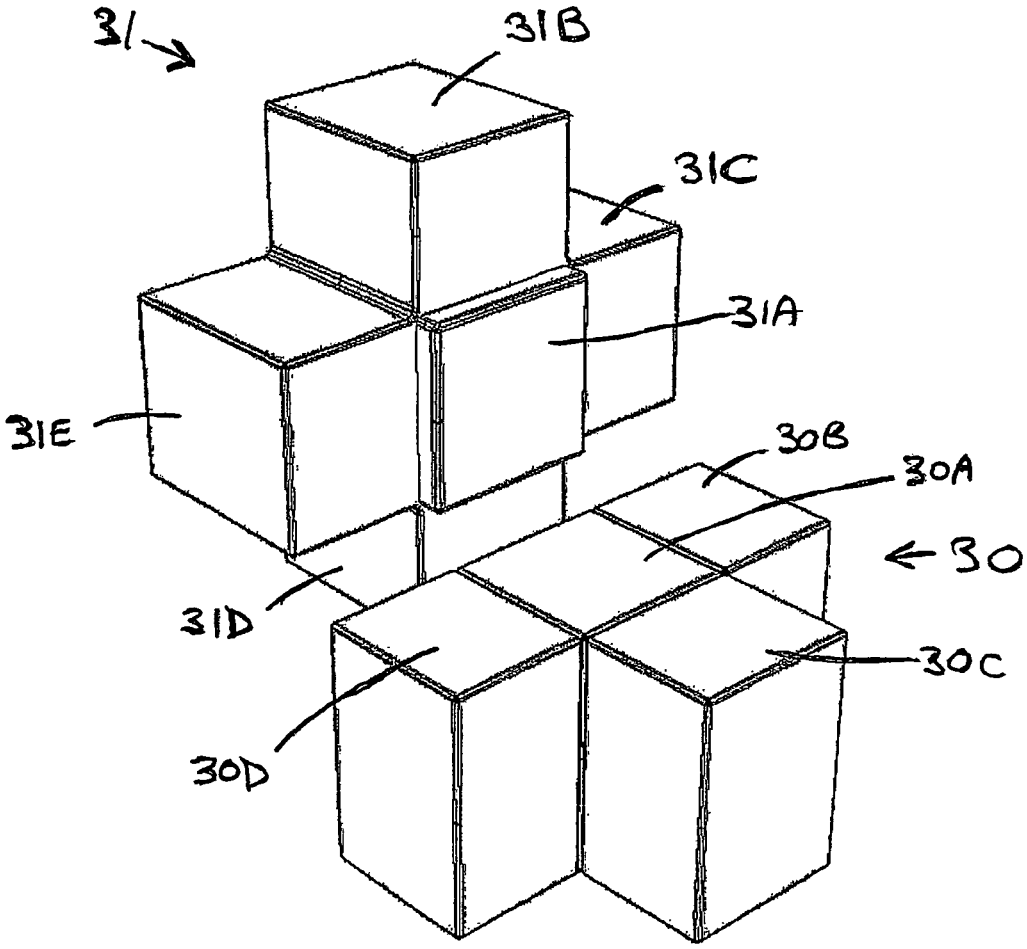
FIG. 7 is a perspective view of magnets used in the apparatus shown in the preceding figures.

FIG. 7 is a perspective view of first and second magnets 30, 31 as used in the apparatus described above.

The first magnet 30 which is mounted in the base portion is made up of four pieces assembled in the form of a T. The four pieces are secured or held in the configuration shown by being fitted within a support member (not shown) and/or by adhesive. The centre magnet 30A is orientated with its magnetic axis vertical and its North Pole uppermost. The three magnets 30B, 30C and 30D assembled around this are orientated with their magnetic axes horizontal and their North Poles innermost, i.e. adjacent the centre magnet 30A.

The second magnet 31 which is mounted in the top portion is made up of five pieces assembled in the form of a cross. The five pieces are held in the configuration shown by a support member 8 (as shown in FIGS. 1, 4 and 5) and/or are secured together, e.g. by means of adhesive. The centre magnet 31A is orientated with its magnetic axis horizontal and its South Pole at the front end which projects from the front face 2A of the top portion. The four magnets 31B, 31C, 31D and 31E are assembled around the centre magnet 31A with their magnetic axes perpendicular to that of the centre magnet 31A and their South Poles innermost, i.e. adjacent the centre magnet 31A. The polarity of all the parts could also be arranged the other way around.

The configuration of both the first and second magnets 30, 31 is such that the pieces thereof tend to repel each other. They therefore have to be held in the configurations shown by being mounted in appropriate supports within the top portion and base portion and/or by suitable adhesive. It is found that the complex magnetic fields created by this arrangement of magnets provide the required forces which attract the head of the security device towards the second magnet 31 and enable the first magnet 30 to move the locking arm 28 so as to unlock the security device 20 so it can be separated from the article 21. Other configurations of magnets for performing this function are also possible.

As indicated above, the apparatus described herein can be used with a wide variety of articles of different shapes and sizes, in particular articles which are of a size and/or shape which could not be inserted into a narrow rectangular opening as provided in the apparatus described in GB2371597A. The security device of the type described and/or as illustrated in FIG. 6 can be used in many different articles so long as the article has a first side into which the arms thereof can be inserted such that the head of the device lies adjacent the first side and a second side adjacent to the first side and adjacent which the locking arm of the device is positioned so it can be moved by a magnetic field applied through said second side.

The invention claimed is:

1. Apparatus for releasing a magnetic security device in an article, the apparatus comprising:

a) a first portion for locating the article in a first direction;

b) a second portion for locating the article in a second direction substantially perpendicular to the first direction;

c) wherein the first and second portions define a receptacle configured and adapted to receive the article so as to physically restrain the article in the first and second directions as it is brought into contact with the first and second portions, while leaving the article unrestrained in at least a third direction substantially perpendicular to the first and second directions, the receptacle being configured and adapted to receive first and second surfaces of the article that are wider than the apparatus, such that the article when received in the receptacle may extend beyond the apparatus in the third direction and may extend beyond the apparatus in a fourth direction opposite the third direction; and d) at least one of the first and second portions including magnetic release means arranged to assist in locating the article, when the article is initially misaligned, into alignment in the third direction by magnetic attraction of the security device as the article is brought into contact with the at least one of the first and second portions, the magnetic release means being arranged to provide a first magnetic force in the first direction and a second magnetic force in the second direction for releasing the magnetic security device from the article.

2. Apparatus as claimed in claim 1 in which the first portion defines a first plane and the second portion defines a second plane substantially perpendicular to the first plane.

3. Apparatus as claimed in claim 2 in which the first and second planes define a receptacle having a substantially L-shaped cross-section.

4. Apparatus as claimed in claim 1 in which the first and second portions respectively comprise a base portion and a top portion upstanding therefrom.

5. Apparatus as claimed in claim 4 in which the first and second portions are connected together by means of at least one mutually engageable projection and recess.

6. Apparatus as claimed in claim 1 in which a first magnet mounted in the first portion provides the magnetic force in the first direction and a second magnet mounted in the second portion provides the magnetic force in the second direction.

7. Apparatus as claimed in claim 6 in which at least one of the first and second magnet comprises a plurality of parts which are held together in a configuration in which they tend to repel each other.

8. Apparatus as claimed in claim 7 in which at least one of the first and second magnets comprise a central part with a plurality of further parts adjacent thereto, the magnetic axes of each of the further parts being perpendicular to that of the central part.

9. Apparatus as claimed in claim 1 having closure means moveable between an open position which provides access to the magnetic release means and a closed position which prevents an article being presented to the magnetic release means.

10. Apparatus as claimed in claim 9 in which the closure means comprises a slideable or pivotable cover.

11. Apparatus as claimed in claim 9 having locking means for locking the closure means in the closed position.

12. A method of releasing a magnetic security device comprising the steps of providing an apparatus as claimed in claim 1 and presenting the article with the magnetic security device thereto to release the magnetic security device therefrom.

13. Apparatus for releasing a magnetic security device in an article, the apparatus comprising:

a) a first portion for locating the article in a first direction;

b) a second portion for locating the article in a second direction substantially perpendicular to the first direction;

c) wherein the first and second portions define an L-shaped receptacle configured and adapted to restrain the article in the first and second directions as it is brought into contact with the first and second portions, while leaving the article unrestrained in at least a third direction substantially perpendicular to the first and second directions, the L-shaped receptacle being capable of receiving articles of a wide range of shapes and sizes having a security device installed adjacent two substantially perpendicular sides thereof, the receptacle being configured and adapted to receive the article having first and second surfaces that are wider in the third direction than the apparatus; and d) at least one of the first and second portions including magnetic release means arranged to provide a first magnetic force in the first direction and a second magnetic force in the second direction for releasing the magnetic security device from the article, wherein the receptacle is adapted and configured to receive the article such that the size of the surfaces of the article within the receptacle are unrestricted in at least the third direction and a fourth direction opposite the third direction.

14. Apparatus as claimed in claim 13 in which at least one of the first and second portions are arranged to assist in locating the article in a third direction substantially perpendicular to the first and second directions by magnetic attraction of the security device as the article is brought into contact with the first and second portions so as to align the magnetic security device with the magnetic release means.

15. An apparatus for releasing a magnetic security device, the apparatus comprising:

a) a first portion for locating an article in a first direction and a second portion for locating an article in a second direction substantially perpendicular to the first direction, the first and second portions forming a receptacle for receiving the article but physically restraining the article in the first and second directions as it is brought into contact with the first and second portions;

b) at least one of the first and second portions including magnetic release means arranged to assist in locating the article in a third direction substantially perpendicular to the first and second directions by magnetic attraction of the security device as the article is brought into contact with the at least one of the first and second portions so as to align the magnetic security device with the magnetic release means, the magnetic release means being arranged to provide a first magnetic force in the first direction and a second magnetic force in the second direction for releasing a magnetic security device from the article; and c) closure means moveable between an open position which provides access to the magnetic release means and a closed position which prevents an article being presented to the magnetic release means.

16. An apparatus as claimed in claim 15 in which the closure means comprises a slideable or pivotable cover.

17. An apparatus as claimed in claim 15 having locking means for locking the closure means in the closed position.

18. An apparatus for releasing a magnetic security device in an article, the apparatus comprising:

a) a first portion for locating the article in a first direction and second portion for locating the article in a second direction substantially perpendicular to the first direction, the first and second portions defining a receptacle configured and adapted to receive first and second surfaces of the article such that the first and second surfaces of the article when received in the receptacle may extend beyond the apparatus in a third direction that is substantially perpendicular to the first and second directions, and may extend beyond the apparatus in a fourth direction opposite the third direction; and b) magnetic release means associated with the receptacle for releasing the magnetic security device in the article.

* * * * *